US005203395A

United States Patent [19]

Koller et al.

[11] Patent Number: 5,203,395

[45] Date of Patent: Apr. 20, 1993

[54] ADJUSTABLE RUFFLE WINDOW SHADE

[75] Inventors: Barbara J. Koller, Lake Wylie, S.C.; Jerome Ohnstad, Charlotte, N.C.

[73] Assignee: CHF Industries, Charlotte, N.C.

[21] Appl. No.: 853,906

[22] Filed: Mar. 19, 1992

[51] Int. Cl.[5] ..... A47G 5/02

[52] U.S. Cl. ..... 160/263; 160/121.1

[58] Field of Search ..... 160/263, 330, 121.1, 160/123, 124

[56] References Cited

U.S. PATENT DOCUMENTS

| | | | |
|---|---|---|---|
| 1,099,258 | 6/1914 | Koziell . | |
| 1,132,100 | 3/1915 | Klein . | |
| 1,170,068 | 2/1916 | Hoyt . | |
| 1,220,567 | 3/1917 | Schuler et al. . | |
| 1,791,647 | 2/1931 | Stacks . | |
| 2,317,917 | 4/1943 | Kasan . | |
| 2,341,233 | 2/1944 | Norton . | |
| 2,500,074 | 3/1950 | Hill | 160/123 |
| 2,520,653 | 8/1950 | Rand | 160/330 X |
| 2,587,492 | 2/1952 | Lipetz | 160/330 X |
| 2,837,152 | 6/1958 | Moore, Jr. . | |
| 2,943,676 | 7/1960 | Grenci . | |
| 3,202,206 | 8/1965 | Boulanger . | |
| 3,203,468 | 8/1965 | Gossling et al. . | |
| 3,299,944 | 1/1967 | Gossling et al. . | |
| 3,308,874 | 3/1967 | Anderson . | |
| 3,580,323 | 5/1971 | Gossling . | |
| 3,780,921 | 12/1973 | Harp . | |
| 3,913,655 | 10/1975 | Ogino . | |
| 4,006,770 | 2/1977 | Ferguson . | |
| 4,101,383 | 7/1978 | Miller . | |
| 4,102,384 | 7/1978 | Gossling . | |
| 4,102,385 | 7/1978 | Miller . | |
| 4,157,108 | 6/1979 | Donofrio . | |
| 4,373,569 | 2/1983 | Barettella . | |
| 4,403,641 | 9/1983 | Reeder . | |
| 4,539,239 | 9/1985 | Graves et al. . | |
| 4,566,517 | 1/1986 | Simon . | |
| 4,567,930 | 2/1986 | Fischer . | |
| 4,619,305 | 10/1986 | Comeau . | |
| 4,625,868 | 12/1986 | Bischof . | |

*Primary Examiner*—David M. Purol

*Attorney, Agent, or Firm*—Lee, Mann, Smith, McWilliams, Sweeney & Ohlson

[57] ABSTRACT

An adjustable width window shade having an adjustable roller assembly and a shade panel which includes top and bottom edge portions and a pair of side portions. One of the side portions includes a plurality of lines of weakness which may be selectively torn away to provide an adjustable width portion. A decorative member is disposed along the bottom portion of the shade panel and is removably attached to the adjustable width portion of the shade panel. The decorative member can be readily adjusted as the width of the shade panel is adjusted.

13 Claims, 1 Drawing Sheet

ADJUSTABLE RUFFLE WINDOW SHADE

BACKGROUND OF THE INVENTION

The invention relates to retractable window shade arrangements and more particularly to window shade arrangements of adjustable width which include a decorative member such as a ruffle along a bottom portion thereof. Retractable window shades are well known in the art. To provide a proper fit, it was previously necessary that the entire window shade and roller assembly be cut and portions thereof reattached to provide for proper fit. Recently, window shade arrangements have been provided which allow for adjustability to various window widths by the end user. These assemblies commonly include a sheet of vinyl or other material, a roller assembly to which the sheet of material is attached, a spring driven motor or mechanism for driving the motor and a light weight slat inserted in a seam along the bottom edge of the shade material to provide rigidity. Such shades have included tear-lines parallel to one side edge of the shade from the top edge to the bottom edge thereof which can be readily torn away to provide for fitting of the shade to a proper width. Such window shade arrangements which are readily adjustable have not allowed for any decorative options or accessories to be readily adjustable therewith and thus, versatility is extremely limited. The present invention provides a window shade arrangement which is readily adjustable to various window widths and includes a decorative member such as a ruffle or ruched band (i.e. a ruffle which is gathered and sewn at both top and bottom) along the width thereof which can be readily adjusted according to the width of the shade.

SUMMARY OF THE INVENTION

The present invention provides an extendable and retractable roll window shade arrangement which is width adjustable without the use of tools or cutting instruments and includes a decorative member along the width thereof. The shade includes an adjustable roller assembly and a shade panel of flexible material secured to a portion of the roller assembly at the top portion thereof. The shade panel includes a width adjustable portion having a plurality of lines of weakness extending from the top portion of the shade panel to the bottom portion of the shade panel whereby the width of the shade can be adjusted to the necessary width. A decorative member such as a ruffle or ruched band is disposed across the width of the shade and includes a top edge portion and a free bottom edge portion. A first length of the top edge of the ruffle is permanently attached to a side portion of the shade panel opposite the width adjustable portion. The remaining length of the top edge of the ruffle is removably attached to the width adjustable portion at the bottom portion of the shade panel. An adhesive means is provided for adhesively and removably attaching a doubled-under side edge of the ruffle to an underlying portion of the ruffle upon adjustment of the width of the shade arrangement.

DETAILED DESCRIPTION OF THE PREFERRED EMBODIMENT

Figure 1:
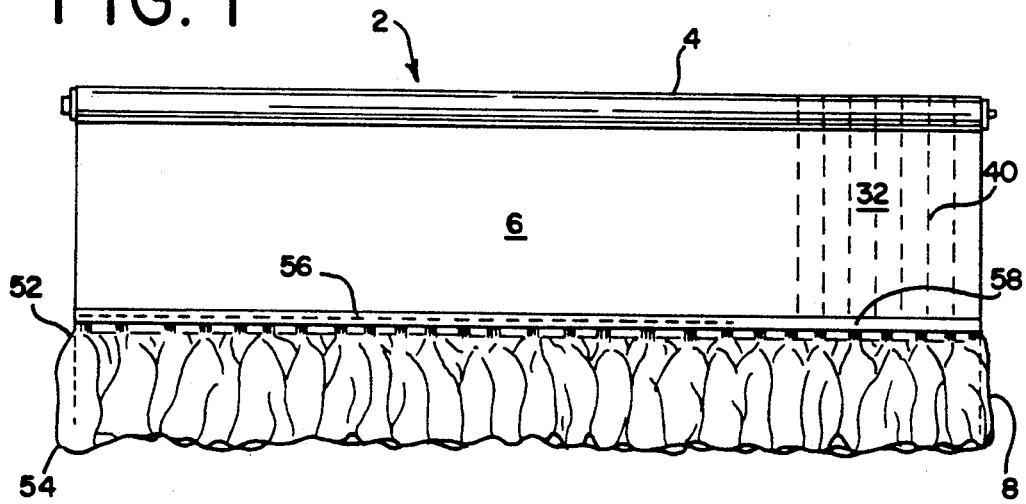
FIG. 1 is a front elevational view of a window shade arrangement of the present invention.
Figure 4:
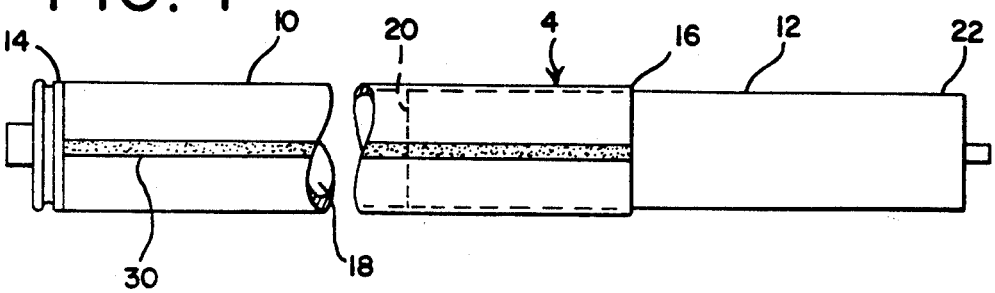
FIG. 4 is a cross sectional view of the roller assembly of the present invention.

As shown in FIG. 1, an adjustable shade arrangement 2 of the present invention includes a roller assembly 4, a shade panel 6 of flexible material and a decorative member such as a ruffle 8 disposed along the width of the shade panel 6. As best seen in FIG. 4, the roller assembly 4 includes a first roller section 10 and a second roller section 12. The first roller section 10 includes a first end 14 and a second end 16. A hollow opening 18 extends through the first roller section 10, the function of which will be apparent herein. The first roller section 10 has a constant outer diameter along its entire length which is larger than the outer diameter of the second roller section 12. The second roller section 12 includes a first end 20 and a second end 22. The first end 20 of the second roller section 12 is slidably and telescopingly disposed within the opening 18 of the first roller section 10 at the second end 16 thereof to allow for adjustment of the roller assembly 4 to a desired width within the range of telescoping action of the roller assembly 4. Alternatively, the roller assembly 4 can have a perforated portion, whereby a portion of the roller assembly can be removed to adjust the width of the roller assembly.

As best seen in FIG. 4, the roller assembly 4 further includes a strip of adhesive 30 disposed along a portion of the first roller section 10 to provide a means for securing a portion of the top portion of the shade panel 6 to the first roller section 10.

The shade panel 6 is made of a flexible material such as cloth or vinyl and includes a plurality of lines of weakness 40 extending from the top edge of the shade panel 6 to the bottom edge thereof to provide a width adjustable portion 32, whereby the width of the shade panel 6 can be adjusted as needed. The lines of weakness 40 can be formed by perforating or partially slitting the shade panel or by chemical etching. A sleeve 42 is formed at the bottom edge of the shade panel 6 by folding the bottom edge under and securing the folded portion to the back side of the shade panel 6. A slat 44 is disposed within the sleeve 42 to provide rigidity to the shade panel 6 upon hanging. The slat 44 includes a plurality of score lines 46 disposed along the entire length thereof to allow a portion of the slat 44 to be readily removed and thus adjusted to a shorter width as necessary.

The ruffle 8 is disposed along the width of the shade panel 6 at the bottom portion thereof. The ruffle 8 includes a gathered top edge portion 52 and a free bottom edge portion 54. A first length 56 of the gathered top edge portion 52 of the ruffle 8 is permanently attached to the shade panel 6 exclusive of the width adjustable portion 32. The first length 56 of the gathered top edge portion 52 can be permanently attached to the shade panel by adhesive, by sewing, by stapling or by any other suitable means. A remaining length 58 of the gathered top edge portion 52 of the ruffle 8 is removably attached to the shade panel 6 at the width adjustable portion 32. The remaining length 58 is removably attached to the shade panel preferably by a pressure sensitive adhesive strip 60, which permits removal of that portion of the ruffle and reattachment after the width of the shade panel 6 has been adjusted. The pressure sensitive adhesive strip is not only inexpensive but it provides a tight, uniform attachment similar to the permanent attachment of the first length 56 of the ruffle top edge portion. The remaining length 58 of the edge portion could alternatively be attached by snaps, a hook and loop fastener, hooks and eyes, or any other suitable means.

Figure 3:
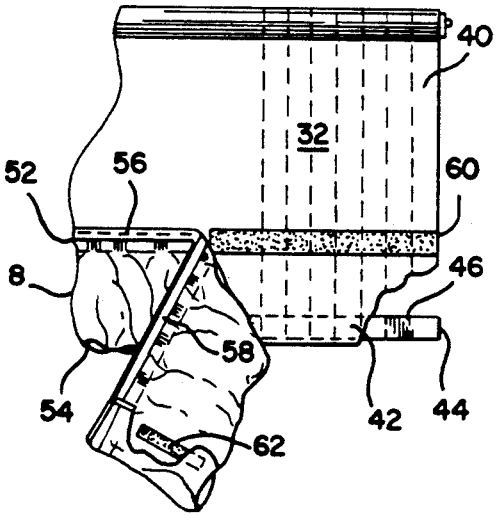
FIG. 3 is a front elevational view partially in section of a window shade of the present invention showing the ruffle folded back and adhered to the underside thereof.

As best seen in FIG. 3, a side edge of the ruffle 8 is folded under and secured to the overlying ruffle by a piece of double sided adhesive tape 62. That remaining length 58 of the ruffle with the side edge folded under is then reattached to the shade panel along the pressure sensitive adhesive strip 60. Although a double sided adhesive tape 62 provides the most preferred means of attachment the attachment can be by other suitable means such as snaps, hooks and eyes, or a hook and loop fastener, thereby providing a finished side edge to the ruffle 8. For best appearance the side edge of the ruffle to be folded under should not exceed about an inch in length. Therefore trimming of the edge with scissors may be desirable.

Instead of a ruffle 8 the decorative member may be a ruched band, which is somewhat similar to a ruffle except that it is gathered both at the top and bottom edge portions, and these gathered top and bottom portions are sewn to a backing or liner. Since there are two gathered portions with a ruched band there should be two pressure sensitive strips 60, the lower strip preferably being along the exterior of the slat sleeve 42. Also, since the ruched band is heavier than a ruffle, it is essential that the excessive length be cut or trimmed to about ¼ inch longer than the width of the shade and folded under before reattachment to the shade panel along the aforementioned two pressure sensitive adhesive strips. In the case of a ruched band, the additional securement of the folded under side edge portion to the over lying portion is usually unnecessary and the double sided adhesive tape 62 may be eliminated.

Figure 2:
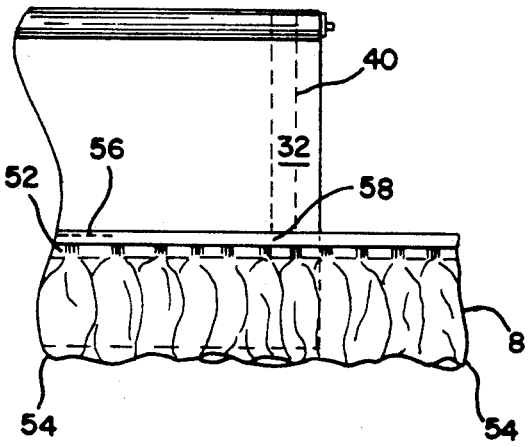
FIG. 2 is a front elevational view partially in section of a window shade, arrangement of the present invention which has been width adjusted.

In use, the shade panel 6 is unrolled from the roller assembly 4 on a flat surface. The slat 44 is removed from the sleeve 42. A portion of the shade panel 6 is removed along one of the lines of weakness 40 from the top portion of the shade panel 6 to the bottom portion of the shade panel 6 to adjust the shade panel 6 to the appropriate width, as shown in FIG. 2. The roller assembly 4 is adjusted to the appropriate width by the telescoping action provided by the first and second roller sections 10 and 12. The remaining length 58 of the ruffle 8 or other decorative member is pulled back away from the adhesive strip (or strips) 60 and its width is adjusted according to the width of the adjusted shade panel 6. As shown in FIG. 3, a portion of the ruffle 8, not needed, is either cut with scissors and/or folded under and adhered to the back side of the ruffle 8 by the piece of double sided tape 62 or other suitable means. The remaining length 58 of the ruffle 8 can then be reattached to the shade panel 6 by the remainder of adhesive strip 60. Finally, a portion of the slat 44 is removed along one of the score lines 46 to adjust the slat 44 to the necessary width of the shade panel 6 and the slat 44 is reinserted into the sleeve 42.

Various features of the invention have been shown and described in connection with the illustrated embodiments of the invention. However, it must be understood that these particular arrangements merely illustrate, and that the invention is to be given the fullest interpretation within the terms of the appended claims.

We claim:

1. An adjustable width window shade comprising an adjustable roller assembly, a shade panel having top and bottom portions and a pair of side portions, at least one of said side portions having a plurality of lines of weakness therein defining strips of the shade panel side portion which may be selectively torn away to provide a width adjustable portion, means for affixing the top portion of said shade panel exclusive of said width adjustable portion to a portion of said roller assembly, a decorative member having a top edge portion, means for affixing a first length of said decorative member top edge portion to said shade panel bottom portion exclusive of said width adjustable portion, and means for removably attaching the remaining length of said decorative member top edge portion to said width adjustable portion of said shade panel bottom portion, whereby the remaining length of said decorative member can be detached and adjusted to match the adjusted width of the shade panel and then reattached to said shade panel.

2. An adjustable width shade as in claim 1 wherein said adjustable roller assembly includes a pair of elongated, axially telescoping members, whereby the axial dimension of the assembly may be adjusted.

3. An adjustable width shade as in claim 1 wherein said means for affixing the top portion of said shade panel includes a strip of adhesive disposed along a portion of said roller assembly.

4. An adjustable width shade as in claim 1 wherein said decorative member is a ruffle having a gathered top edge portion and a free bottom edge.

5. An adjustable width shade as in claim 1 wherein said means for affixing said first length of said decorative member is adhesive.

6. An adjustable width shade as in claim 1 wherein said means for affixing said first length of said decorative member is by stitching said decorative member top edge portion to said shade panel.

7. An adjustable width shade as in claim 1 wherein said means for removably attaching said remaining length of said decorative member top edge portion is a strip of pressure sensitive adhesive.

8. An adjustable width shade as in claim 1 wherein said means for removably attaching said remaining length of said decorative member top edge portion is snaps.

9. An adjustable width shade as in claim 1 wherein said means for removably attaching remaining length of said decorative member top edge portion is a hook and loop fastener.

10. An adjustable width shade as in claim 1 wherein said means for removably attaching said remaining length of said decorative member top edge portion is hooks and eyes.

11. An adjustable width shade as in claim further comprising means for attaching a doubled under side edge of said decorative member to an underlying portion thereof, whereby a finished side edge is formed for said decorative member.

12. An adjustable width shade as in claim 11 wherein said means for attaching a doubled under side edge of said decorative member includes a length of double sided adhesive material.

13. An adjustable width window shade assembly including a shade panel having a decorative member, extending along the bottom thereof and a length adjustable roller having a first length portion and an adjustable length portion, said shade panel having a fixed width main portion and a width adjustable side portion, said side portion having a plurality of spaced lines of weakness therein defining strips which may be selectively torn away to narrow said width adjustable side portion to a predetermined width, said main portion of said shade panel being affixed at its top to said fixed length portion of said roller, a portion of said decorative member being affixed to the bottom of said main portion of said shade panel, means for removably attaching a second portion of said decorative member to said width adjustable side portion of said shade panel, whereby said second portion can be detached and shortened to match said predetermined width of said side portion and thereafter reattached thereto.

* * * * *